US005318872A

United States Patent [19]

Barbetta et al.

[11] Patent Number: 5,318,872

[45] Date of Patent: Jun. 7, 1994

[54] TONER AND DEVELOPER COMPOSITIONS WITH FLUOROPHOSPHATE CHARGE ENHANCING ADDITIVES

[75] Inventors: Angelo J. Barbetta, Penfield; Thomas R. Hoffend, Webster, both of N.Y.

[73] Assignee: Xerox Corporation, Stamford, Conn.

[21] Appl. No.: 42,220

[22] Filed: Apr. 2, 1993

[51] Int. Cl.[5] ..... G03G 9/097

[52] U.S. Cl. ..... 430/106.6; 430/110; 430/126

[58] Field of Search ..... 430/110, 126, 106.6

[56] References Cited

U.S. PATENT DOCUMENTS 2,297,691 10/1942 Carlson ..... 430/124

FOREIGN PATENT DOCUMENTS 284000 9/1988 European Pat. Off. ..... 430/110

*Primary Examiner*—Christopher Rodee

*Attorney, Agent, or Firm*—E. O. Palazzo

[57] ABSTRACT

A toner composition comprised of resin, pigment particles, and a distearyl dimethyl ammonium hexafluorophosphate charge enhancing additive.

16 Claims, No Drawings

TONER AND DEVELOPER COMPOSITIONS WITH FLUOROPHOSPHATE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a positive charge to the toner resin particles and enable toners with rapid admix characteristics, especially rapid admix after extended storage, for example three months, and after exposure to high temperatures of, for example, 115° F., stable triboelectric characteristics in embodiments and wherein the fusing properties of the toner resin are relatively constant in embodiments. In embodiments, there are provided in accordance with the present invention toner compositions comprised of resin particles, pigment particles, and certain fluorophosphate charge enhancing additives. In embodiments, the present invention is directed to positively charged toners with a distearyl dimethyl ammonium hexafluorophosphate charge additive. The aforementioned additives in embodiments of the present invention enable, for example, toners with substantial humidity insensitivity, rapid admix of less than about 30 seconds, extended developer life, stable electrical properties, high image print quality with substantially no background deposits, and compatibility with fuser rolls including VITON TM fuser rolls. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. Also, the fluorophosphate charge additives of the present invention can be added to negatively charged toners to reduce the negative triboelectric charge thereof. The toner compositions of the present invention in embodiments thereof maintain their triboelectric charging characteristics for an extended number of imaging cycles, exceeding, for example, 500,000 in a number of embodiments. Also, toner and developer compositions of the present invention can be selected for electrophotographic, especially xerographic, imaging and printing processes, including color processes.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635, which illustrates a toner with a distearyl dimethyl ammonium methyl sulfate charge additive. One disadvantage associated with the charge additive of the '635 patent resides in its apparent inherent instability in some instances thus rendering it substantially unsuitable as a bulk toner constituent in imaging processes, as the additive may thermally and chemically degrade, and react with other toner components.

The following prior art, all United States patents, are mentioned: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; a similar teaching is presented in U.S. Pat. Nos. 4,834,921 and 4,490,455, which discloses toners with, for example, amine salt charge enhancing additives, reference the Abstract of the Disclosure for example, and wherein a is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; U.S. Pat. No. 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634 which discloses toners with charge additives of the formulas presented in column 3, wherein providing that at least one of the R's is a long chain amido group, and X is a halide ion or an organosulfur containing group; U.S. Pat. No. 4,326,019 relates to toners with long chain hydrazinium compounds, wherein the anion A can be a sulfate, sulfonate, phosphate, halides, nitrate, see the Abstract of the Disclosure for example; U.S. Pat. No. 4,752,550 which illustrates toners with inner salt charge additives or mixtures of charge additives, see for example column 8; U.S. Pat. No. 4,684,596 which discloses toners with charge additives of the formula provided in column 3 wherein X can be variety of anions such as trifluoromethane sulfonate, and U.S. Pat. Nos. 4,604,338; 4,792,513; 3,893,935; 4,826,749 and 4,604,338. The disclosures of each of the aforementioned patents are totally incorporated herein by reference.

Illustrated in U.S. Pat. No. 4,937,157, the disclosure of which is totally incorporated herein by reference, are toner compositions comprised of resin, pigment, or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. Advantages of the charge additives of the present invention in embodiments thereof over the additives of the aforementioned patent include improved stable toner admix rate performance; usually more acceptable thermal stability and excellent chemical stability with respect to solvolysis permitting improved shelf stability of, for example, the toner charge enhancing properties, rapid admix characteristics at high temperatures, after extended storage, and the like.

Although many charge enhancing additives are known, there continues to be a need for toners with additives, which toners posses many of the advantages illustrated herein. Additionally, there is a need for positive charge enhancing additives which are useful for incorporation into black, and/or colored toner compositions. Moreover, there is a need for colored toner compositions containing certain charge enhancing additives. There is also a need for toner compositions with certain charge enhancing additives, which toners in embodiments thereof possess acceptable substantially stable triboelectric charging characteristics, and excellent admixing properties. Moreover, there continues to be a need for positively charged toner and developer compositions. Further, there is a need for toners with certain charge enhancing additives which can be easily and permanently dispersed into toner resin particles. There also is a need for positively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. Nos. 4,265,990; 4,585,884; 4,584,253 and 4,563,408, the disclosures of which are totally incorporated herein by reference. Also, there is a need for toner compositions which have the desired triboelectric charge level, for example from about 10 to about 40 microcoulombs per gram, and admix charging rates of from about 15 to about 60 seconds, and preferably from about 5 to about 30 seconds, as determined by the charge spectrograph, preferably for example at low concentrations, that is for example less than or equal to 1 percent of the charge enhancing additive of the present invention.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing the charge additives illustrated herein.

Another object of the present invention resides in providing toner compositions with mixtures of charge enhancing additives wherein one of the additives can be, for example, a quaternary ammonium hydrogen bisulfate, especially trialkyl ammonium hydrogen bisulfate, or a tetraalkyl ammonium sulfonate, such as dimethyl distearyl ammonium sulfonate.

Also, in another object of the present invention there are provided developer compositions with positively charged toner particles, carrier particles, and the enhancing additives illustrated herein, or mixtures of these additives with other known charge enhancing additives.

In yet a further object of the present invention, there are provided positively charged toner compositions with desirable admix properties of 30 seconds to 60 seconds as determined by the charge spectrograph, and preferably about 15 seconds for example, and more preferably from between about 5 to about 14 seconds, and acceptable stable triboelectric charging characteristics of from about 10 to about 40 microcoulombs per gram.

Additionally, in a further object of the present invention there are provided positively charged magnetic toner compositions, and positively charged colored toner compositions containing therein, or thereon the charge enhancing additives illustrated herein.

In another object of the present invention, there are provided thermally stable charge enhancing additives, that is for example additives which do not degrade in admix properties at high temperatures, for example, of from about 105° to about 125° F., and wherein the toners with the fluorophosphate charge additive retain their rapid admix characteristics, as determined in a charge spectrograph, after extended storage.

Another object of the present invention resides, it is believed, in the formation of substantially humidity insensitive toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic, especially xerographic, apparatuses, that is those exceeding 70 copies per minute.

These and other objects of the present invention can be accomplished in embodiments thereof by providing toner compositions comprised of resin particles, pigment particles, and charge enhancing additives. More specifically, the present invention in embodiments is directed to toner compositions comprised of resin, pigment, or dye, and as a charge additive distearyl dimethyl ammonium hexafluorophosphate.

Examples of second charge additives selected in effective amounts of, for example, from about 0.05 to about 1.0 weight percent, that can be utilized with the aforementioned first ammonium hexafluorophosphate charge additive include, for example, hydrogen ammonium bisulfate charge enhancing additives such as distearyl methyl hydrogen ammonium bisulfate, trimethyl hydrogen ammonium bisulfate, triethyl hydrogen ammonium bisulfate, tributyl hydrogen ammonium bisulfate, didodecyl methyl hydrogen ammonium bisulfate, dihexadecyl methyl hydrogen ammonium bisulfate, distearyl dimethyl ammonium methyl sulfate, and the like in embodiments, reference the U.S. patents mentioned herein and the copending patent application. With mixtures from about 0.05 to about 1.0 percent by weight of the charge enhancing additive of the present invention can be selected, and from about 0.05 to about 1.0 percent of a second charge enhancing additive can be selected in embodiments of the present invention. Other amounts of mixtures may also be selected in embodiments of the present invention.

The aforementioned charge additives can be incorporated into the toner, may be present on the toner surface, or may be present on toner surface additives such as colloidal silica particles. Advantages of rapid admix, appropriate triboelectric characteristics, and the like are achieved with many of the aforementioned toners of the present invention.

In another embodiment of the present invention, there are provided subsequent to known micronization and classification toner particles with an average diameter of from about 7 to about 20 microns comprised of resin particles, pigment particles, and the charge enhancing additive.

A typical preparation for a charge enhancing additive of the present invention, which additive is believed to be available from Hexcel Chemicals, is as illustrated herein and includes the reaction of distearyl dimethyl ammonium chloride with potassium hexafluorophosphate by known ion exchange methods.

The toner compositions of the present invention can be prepared by a number of known methods, such as mixing and heating resin particles such as styrene butadiene copolymers, pigment particles such as magnetite, carbon black, like REGAL 330®, or mixtures thereof, and preferably from about 0.5 percent to about 5 percent of the aforementioned charge enhancing additive, or mixtures of charge additives, in a toner extrusion device, such as an extruder available from Werner Pfleiderer, and removing the formed toner composition from the device. Subsequent to cooling, such as cooling in air or water, the toner composition is subjected to grinding utilizing, for example, a Sturtevant micronizer for the purpose of achieving toner particles with a volume median diameter of less than about 25 microns, and preferably of from between about 5 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, polyolefins, styrene acrylates, styrene methacrylates, styrene butadienes, crosslinked styrene polymers, polyamides, polyurethanes, vinyl resins, including homopolymers or copolymers of two or more vinyl monomers; and polyesters, such as those obtained from the polymeric esterification of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected. Also, there may be selected as toner resins the polyesters of copending patent applications U.S. Ser. No. 814,641 and U.S. Pat. No. 5,227,460, the disclosures of which are totally incorporated herein by reference.

As one toner resin, there can be selected the esterification product of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 500 to about 20,000, such as polyethylene, polypropylene, and paraffin waxes, can be included in, or on the toner compositions as fuser roll release agents. These waxes are usually present in effective amounts of, for example, from between about 1 to about 10 weight percent.

The resin particles are present in a sufficient, but effective amount, for example from about 60 to about 95 weight percent in embodiments. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment can be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling, for example, single component toners, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL® like AEROSIL R972®, metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL® like AEROSIL R972®, can be surface treated with the charge additives of the present invention illustrated herein in an amount of from about 1 to about 30 weight percent, and preferably 10 weight percent followed by the addition thereof to the toner in an amount of from 0.1 to 10 and preferably 0.1 to 1 weight percent.

Also, there can be included in the toner compositions of the present invention as indicated herein low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have, it is believed, a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Included within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, especially a polymeric coating, the coating generally being comprised of terpolymers of styrene, methylmethacrylate, and a silane, such as triethoxy silane, reference U.S. Pat. Nos. 3,526,533 and 3,467,634, the disclosures of which are totally incorporated herein by reference; polymethylmethacrylates; other known coatings; and the like. The carrier particles may also include in the coating, which coating can be present in one embodiment in an amount of from about 0.1 to about 3 weight percent, conductive substances, such as carbon black like VULCAN® carbon black available from Cabot Corporation, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 30 microns to about 500 microns, and preferably from about 50 microns to about 150 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner composition of the present invention can be prepared by a number of known methods as indicated herein including extrusion, melt blending the toner resin particles, pigment particles or colorants, and the charge enhancing additive of the present invention as indicated herein, followed by mechanical attrition and optional classification to provide toner particles with an average diameter of from between about 5 to about 25 microns. Other methods include those well known in the art such as spray drying, melt dispersion, extrusion processing, dispersion polymerization, emulsion polymerization and suspension polymerization. Also, the toner composition without the charge enhancing additive can be prepared, followed by the addition of surface treated with charge additive colloidal silicas. More specifically, the toner compositions of the present invention can be prepared by a number of known methods, such as mixing and heating resin particles such as styrene butadiene copolymers, pigment particles such as magnetite, carbon black, or mixtures thereof, and preferably from about 0.5 percent to about 5 percent of the aforementioned fluorophosphate charge enhancing additive, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from between about 5 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Also, the toner compositions of the present invention in embodiments thereof possess desirable narrow charge distributions, optimal charging triboelectric values, preferably of from 10 to about 40, and more preferably from about 10 to about 25 microcoulombs per gram with from about 0.1 to about 5 weight percent in embodiments of the charge enhancing additive. More specifically, in embodiments toners with the charge additive of the present invention enable achieving a combination of desirable important characteristics, that is the provision of toners with rapid charge acceptance/rapid admix values; minimal or no effect on the toner admix rate by storage of the toner at elevated temperatures of, for example, 115° F. for extended time periods of, for example, 24 hours; the toner tribocharge is substantially independent of relative humidity conditions; the toner triboelectric charge level is maintained at acceptable levels for extended time periods when such toner is utilized in, for example, xerographic imaging and printing processes; the charge additive has no, or substantially minimal impact on the temperature required for image fusing; and the toner with the charge additive does not reduce the effective life of VITON TM coated fuser rolls.

When the charge additive of the present invention is utilized in admixtures with other additives, for example alkyl pyridinium halides, organic sulfates, organic sulfonates, the bisulfates illustrated herein, distearyl dimethyl ammonium methyl sulfate, and the like, generally there is present in the mixture an effective amount of each additive, such as for example from about 30 to about 80 percent by weight of the first additive of the present invention, and from about 20 to about 70 weight percent of the second charge additive in an embodiment of the present invention, from about 40 to about 60 percent by weight of the first additive of the present invention, and from about 60 to about 40 weight percent of the second charge additive in another embodiment of the present invention.

The following Examples are being supplied to further define various species of the present invention, it being noted that these Examples are intended to illustrate and not limit the scope of the present invention. Parts and percentages are by weight unless otherwise indicated. Comparative Examples are also provided.

EXAMPLE I

There was prepared in an extrusion device, available as ZSK28 from Werner Pfleiderer, a toner composition by adding thereto 80 percent by weight of styrene butadiene copolymer resin particles (91/9), reference U.S. Pat. No. 4,558,108, the disclosure of which is totally incorporated herein by reference; 16 percent by weight of the magnetite MAPICO BLACK ®; 3 percent by weight of REGAL 330 ® carbon black; and 1 percent by weight of the charge enhancing additive distearyl dimethyl ammonium hexafluorophosphate (DDAHP) obtained from Hexcel Chemicals. The toner product, which was extruded at a rate of 15 pounds per hour, reached a melting temperature of 381° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 9.5 microns as measured by a Coulter Counter. Thereafter, the aforementioned toner particles were classified in a Donaldson Model B classifier for the purpose of removing fine particles, that is those with a volume median diameter of less than 5 microns.

Subsequently, the above formulated toner, 3 parts by weight, was mixed with 97 parts by weight of a carrier containing a 130 micron steel core with a polymer mixture thereof, 0.70 percent by weight, which polymer mixture contained 40 parts by weight of KYNAR ®, a polyvinylidene fluoride, and 60 parts by weight of polymethylmethacrylate, and wherein mixing was accomplished in a paint shaker for 10 minutes. These resulted on the toner composition, as determined in the known Faraday Cage apparatus, a positive triboelectric charge of 18 microcoulombs per gram. The toner tribocharge can be varied to from about 14 to 22 microcoulombs per gram depending, for example, on the ratio of carrier polymers selected, and the amount of charge additive utilized.

The toner admix time is measured in a charge spectrograph, and is considered the time required for the charge distribution to collapse to a single monomodal peak after the addition of substantially uncharged toner, 1 weight percent to the above prepared developer. Further, the admix times were recorded after the toners were exposed to 115° F. for 24 hours, reference the data that follows.

EXAMPLE II

A number of toners and developers were prepared by repeating the processes of Example I with the exceptions that the charge additive was replaced with the charge additives hexane 1,6-bis(triethyl ammonium hexafluorophosphate) (HETEAP), butanetriethyl ammonium hexafluorophosphate (BUTEAP), tetrabutyl ammonium bisulfate (TBABS), tributylhydrogen ammonium tosylate (TBHAT), tetramethyl ammonium tosylate (TMAT), distearyl dimethyl ammonium methyl sulfate (DDAMS), butane 1,4-bis(tributyl ammonium hexafluorophosphate) (BUTBAP), or cetyl pyridinium chloride (CPC), respectively, and the carrier coating ratio was changed as indicated hereinafter, and the carrier coating weight in all instances was 0.7 weight percent with the following results; and including the toner and developer with the DDAHP charge additive of the present invention.

TABLE 1

| ADMIX PERFORMANCE OF CHARGE CONTROL ADDITIVES | | | | | |
|---|---|---|---|---|---|
| Charge Control Additive | % In Toner | Tribo Level μcoul/gram | Carrier* Type | Admix Time | Admix Time After 115° F./24 Hour Exposure |
| DDAHP | 2.0 | 16 | 40/60 Kynar/PMMA | — | <15 seconds |
| | 1.0 | 20 | 40/60 Tedlar/PMMA | <15 seconds | <15 seconds |
| | 1.0 | 18 | 10/90 Kynar/PMMA | <15 seconds | <15 seconds |
| | 0.75 | 18 | 40/60 Tedlar/PMMA | — | 60 seconds |
| HETEAP | 1.0 | 16 | 40/60 Kynar/PMMA | 30 seconds | 60 seconds |
| BUTEAP | 1.0 | 15 | 45/55 Kynar/PMMA | — | 60 seconds |
| TBABS | 1.0 | 22 | 20/80 Kynar/PMMA | — | 30 seconds |
| TBHAT | 1.0 | 17 | 20/80 Kynar/PMMA | — | 60 seconds |
| TMAT | 1.0 | 14 | 60/40 Kynar/PMMA | — | 15 seconds |
| DDAMS | 0.3 | 16 | 40/60 Kynar/PMMA | 15 seconds | >60 seconds |
| BUTBAP | 1.0 | 19 | 30/70 Kynar/PMMA | 15 seconds | 15 seconds |
| CPC | 2.0 | 15 | 60/40 Kynar/PMMA | <15 seconds | <15 seconds |
| | 0.15 | 16 | 50/50 Kynar/PMMA | 60 seconds | >60 seconds |

*Table values indicate the ratio of KYNAR ® or TEDLAR ® to polymethylmethacrylate. All carriers had a total coating weight of 0.7 percent.

EXAMPLE III

The toners of Example II, Table 1, with a 60 second or less admix value were measured for other performance characteristics as illustrated in Table 2 that follows.

TABLE 2

| PERFORMANCE ATTRIBUTES OF CHARGE CONTROL ADDITIVES | | | | | |
|---|---|---|---|---|---|
| Charge Control Additive | % In Toner | Tribo Ratio 20 to 50% RH/80% RH | Tribo Stability Ratio Cycle 10/Cycle 1 | Tribo Stability Ratio Cycle 20/Cycle 10 | Viton Compatibility Rating |
| DDAHP | 1.0 | 1.35 | 1.119 | 1.08 | Excellent |
| HETEAP | 1.0 | 1.31 | 0.76 | 0.88 | Excellent |
| BUTEAP | 1.0 | 1.50 | 0.72 | 0.95 | Excellent |
| TBABS | 1.0 | 4.32 | — | — | — |
| TMAT | 1.0 | 4.79 | — | — | — |
| DDAMS | 0.3 | 1.34 | 1.71 | 1.05 | Good |
| BUTBAP | 1.0 | 1.51 | 0.66 | 0.91 | Excellent |
| CPC | 2.0 | — | — | — | Poor |

The humidity sensitivity of tribocharge level was determined by the ratio of the toner tribocharge at the highest measured charge level divided by the lowest measured charge level after equilibration for 24 hours at 20 percent RH at 60° F., 50 percent RH at 70° F., and 80 percent RH at 80° F. In all situations, the lowest measured toner charge level was at 80 percent RH/80° F. It is preferred that the tribo ratio be less than 1.5, which indicates a relatively small change in toner tribocharge level as humidity is changed.

The toners were also tested for stability of charge generation by the mixing of each of these toners in a paint shaker for 10 minutes and subsequently measuring the toner tribo level. The toner for each separate developer was removed from the toner/carrier mixture by retaining the carrier on a suitable screen while vacuuming off the toner. Fresh toner with the same components was then added to the retained carrier, and the resulting mixture was placed on a paint shaker for additional 10 minutes. This was repeated 20 times to arrive at a measurement of toner stability. The data in Table 2 contains a ratio of the tribo after 10 tone/detone cycles to the initial, and a ratio of cycle 20 to cycle 10. Preferred in embodiments is that the ratio be greater than one and approach one between cycles 10 and 20. Failure to achieve this stability will result, for example, in a relatively shorter developer life as the toner tribo will degrade with time and the copy or developed image resolution will be poor, for example high background deposits, and unclear images. A ratio approaching one evidences that the developer is stable.

The VITON TM compatibility rating value in Table 2 is an assessment of the chemical compatibility of the charge control additive with the VITON TM elastomer that coats the VITON TM fuser roll. This coating partly conforms to the image as it is fused to generate a rough surface on the fused toner image imparting a matte finish which is preferred. If a toner component, such as a charge additive, chemically attacks the VITON TM, it will cause hardening of the VITON TM or cracking thereof which results in, for example, high gloss images rather than matte finishes, or toner adhesion in the VITON TM cracks which subsequently transfer to the final developed images and cause unwanted spots on the copy.

VITON TM compatibility was determined by contacting a sample pad of the VITON TM with the charge control additive followed by storage at 202° C. for 24 hours. The degree of attack on the VITON TM is assessed visually and by infrared spectroscopy which quantifies the oxidation and unsaturation created in the VITON TM after the 24 hour period. In Table 2, excellent refers to little or no change in the VITON TM; good refers to slight changes in the VITON TM; and poor refers to severe degradation of the VITON TM thus rendering it unuseful.

Other modifications of the present invention may occur to those skilled in the art subsequent to a review of the present application, and these modifications, including equivalents thereof, are intended to be included within the scope of the present invention.

What is claimed is:

1. A toner particle composition consisting of resin, pigment particles, and a distearyl dimethyl ammonium hexafluorophosphate first charge enhancing additive and a second charge enhancing additive of distearyl dimethyl ammonium methyl sulfate.

2. A toner composition in accordance with claim 1 wherein the first charge enhancing additive is present in an amount of from about 0.05 to about 5 weight percent.

3. A toner composition in accordance with claim 1 wherein the first charge enhancing additive is present in an amount of from about 0.1 to about 3 weight percent.

4. A toner in accordance with claim 1 wherein the first charge enhancing additive is present in an amount of from about 0.05 to about 1 percent by weight, and the second charge enhancing additive is present in an amount of from about 0.05 to about 1 percent by weight.

5. A toner composition in accordance with claim 1 wherein the charge additive mixture is incorporated into said toner.

6. A toner composition in accordance with claim 1 with a triboelectric charge of from about 10 to about 50 microcoulombs per gram.

7. A toner composition in accordance with claim 1 wherein the resin is comprised of styrene polymers, polyesters, or mixtures thereof.

8. A toner composition in accordance with claim 7 wherein the resin is comprised of styrene acrylates, styrene methacrylates, polyesters, or styrene butadienes.

9. A toner composition in accordance with claim 1 wherein the pigment particles are carbon black, magnetites, or mixtures thereof.

10. A toner composition in accordance with claim 1 wherein the pigment particles are cyan, magenta, yellow, red, blue, green, brown or mixtures thereof.

11. A developer composition containing a toner particle composition consisting essentially of resin, pigment particles, and a distearyl dimethyl ammonium hexafluorophosphate first charge enhancing additive, and a second charge enhancing additive of distearyl dimethyl ammonium methyl sulfate, and carrier particles.

12. A developer composition in accordance with claim 11 wherein the carrier particles are comprised of ferrites, steel, or an iron powder.

13. A developer composition in accordance with claim 11 wherein the carrier particles are comprised of a core with a polymer coating thereover.

14. A developer composition in accordance with claim 13 wherein the coating is comprised of a polyvinylidine fluoride, a polymethyl methacrylate, or a mixture of polymers not in close proximity in the triboelectric series.

15. A method of imaging which comprises formulating an electrostatic latent image on a photoconductive imaging member, affecting development thereof with a toner particle composition consisting essentially of resin, pigment particles, and a distearyl dimethyl ammonium hexafluorophosphate first charge enhancing additive and a second charge enhancing additive of distearyl dimethyl ammonium methyl sulfate; and thereafter transferring the developed image to a suitable substrate.

16. A method of imaging in accordance with claim 15 wherein the transferred image is permanently fixed to the substrate.

* * * * *